United States Patent [19]

Brady et al.

[11] 4,087,191

[45] May 2, 1978

[54] LARGE MOTION EXPANSION JOINT

[75] Inventors: John F. Brady, Wood Dale; Lawrence F. Pyle, Des Plaines, both of Ill.

[73] Assignee: Felt Products Mfg. Co., Skokie, Ill.

[21] Appl. No.: 763,810

[22] Filed: Jan. 31, 1977

[51] Int. Cl.[2] ..... E01C 11/02

[52] U.S. Cl. ..... 404/69; 14/16.5

[58] Field of Search ..... 404/57, 58, 69, 56; 52/573, 396; 14/16.5

[56] References Cited

U.S. PATENT DOCUMENTS

| | | | |
|---|---|---|---|
| 1,799,574 | 4/1931 | Ward | 14/16.5 |
| 2,084,100 | 6/1937 | McHugh | 404/58 X |
| 3,466,987 | 9/1969 | Shimizu | 14/16.5 X |
| 3,698,292 | 10/1972 | Koester | 14/16.5 X |
| 3,732,021 | 5/1973 | Rizza | 404/57 |
| 3,788,758 | 1/1974 | Scheffel | 404/56 |
| 3,797,952 | 3/1974 | Pommerening | 14/16.5 X |
| 3,830,583 | 8/1974 | Becht | 404/69 |
| 3,850,539 | 11/1974 | Bowman | 404/69 |
| 3,904,304 | 9/1975 | Honegger | 404/69 |
| 3,907,443 | 9/1975 | McLean | 404/56 |

*Primary Examiner*—Nile C. Byers

*Attorney, Agent, or Firm*—Dressler, Goldsmith, Clement, Gordon & Shore, Ltd.

[57] ABSTRACT

A large motion expansion joint having a plurality of parallel load-carrying modules which are disposed transverse to the direction of the roadway. The load-carrying modules generally span the expansion gap between adjacent structural members to support vehicular traffic thereon and include a first end module mounted to an edge of one of the structural members, a second end module mounted to an edge of the other structural member and at least one intermediate module. The intermediate modules carry a plurality of spaced sleeve-like beam guides which are aligned with spaced elongated sleeve-like support beam housings secured to the second end module. A plurality of support beams are fixed to the first end module and slide into the beam guides and housings generally in the direction of the roadway so as to support the intermediate load-carrying modules. During expansion and contraction of the expansion gap, the load-carrying modules slide upon the support beams and move toward and away from each other as the gap width changes. The spacing between modules is positively proportionally maintained during expansion and contraction by linkages interconnecting each adjacent pair of load-carrying modules. Sealing means are mounted upon the load-carrying modules to provide a roadway over the gap.

12 Claims, 11 Drawing Figures

FIG. 1
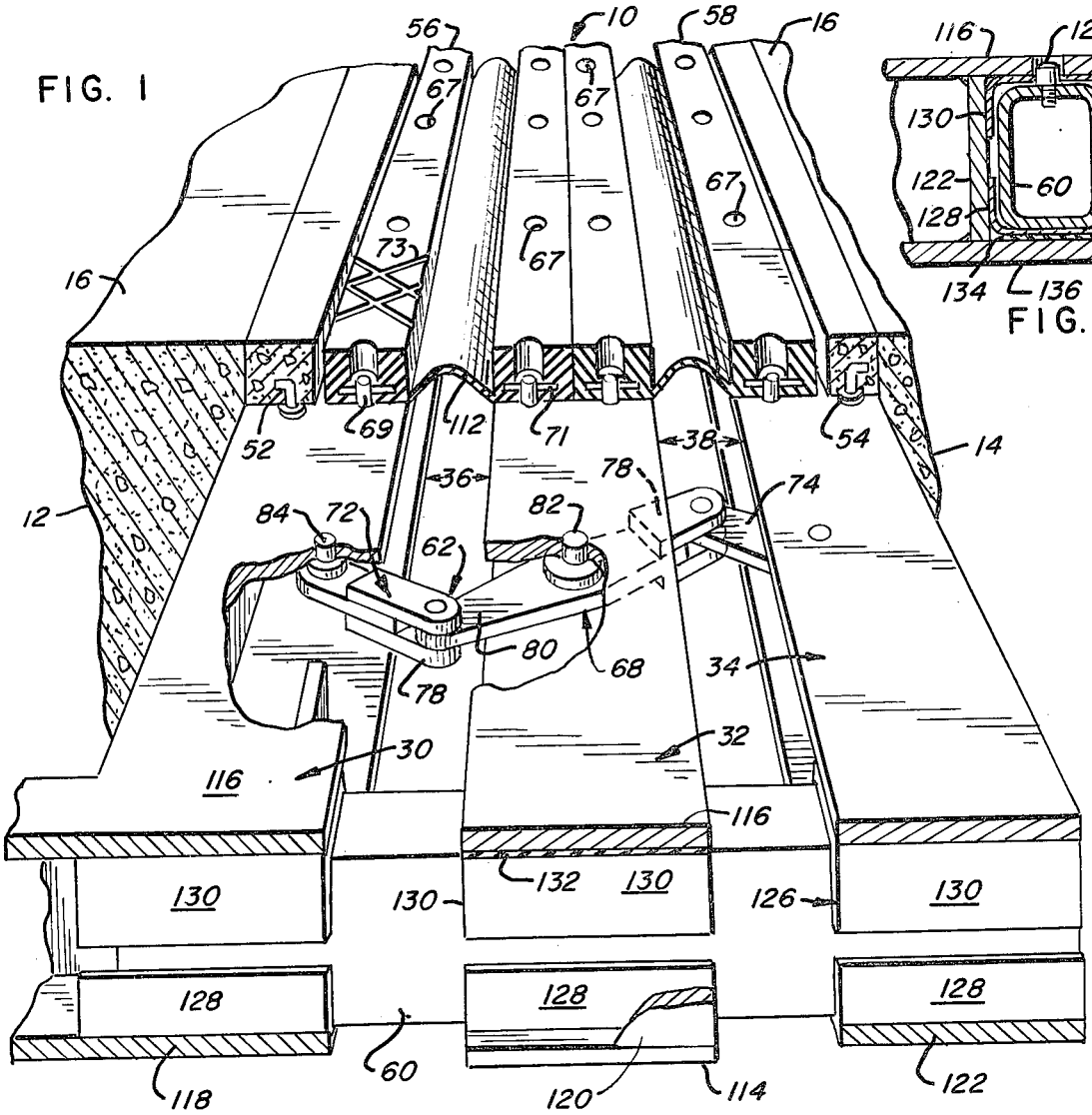
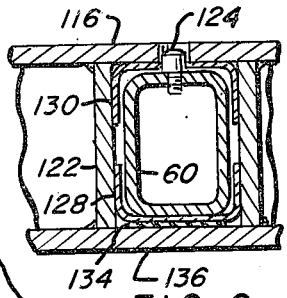
FIG. 6
FIG. 2
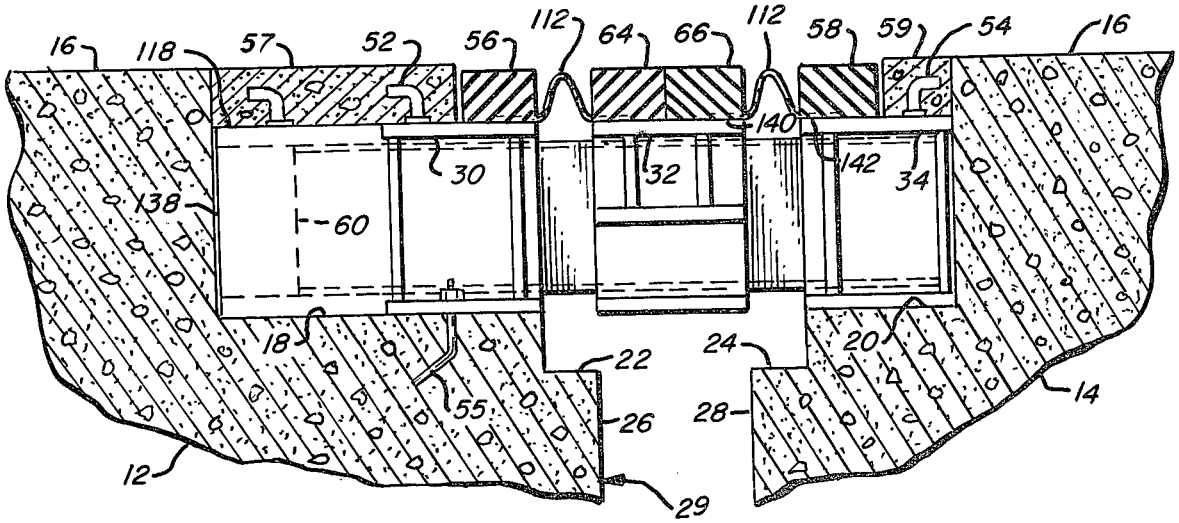

LARGE MOTION EXPANSION JOINT

BACKGROUND OF THE INVENTION

This invention relates to expansion joints for bridges, elevated highways and the like, and more particularly, to large motion composite expansion joints of the type employed in bridge deck constructions for accommodating large movements between adjacent deck sections.

Expansion joints are typically used in those constructions, such as bridge structures and the like, wherein the relative movement between adjacent deck sections in response to temperature changes is too great to be accommodated by a single road joint seal or sealing member.

Various expansion joints have been constructed in the past and met with varying degrees of success. Typical of recent efforts to produce large motion expansion joints are shown in U.S. Pat. Nos. 3,482,492; 3,699,853; 3,604,322; 3,698,292; 3,788,758; 3,830,583; 3,854,159; 3,904,303; 3,904,304. Additionally, lazy-tong linkages have been used to maintain spacing between members dividing roadway gaps uniformly into equal subgaps.

Nevertheless, the need remains for an effective large motion expansion joint to which gap sealing devices as of the types shown in U.S. Pat. No. 3,713,368 may be effectively attached and one in which all of the motion of the underlying support beams may be taken up at one side of the gap.

SUMMARY OF THE INVENTION

In accordance with the present invention, a large motion expansion joint is provided for bridging a gap between edges of structural members along a roadway or the like. The large motion expansion joint includes at least three elongate load-carrying members positioned in parallel relationship to each other and aligned generally transversely to the direction of the roadway. The load-carrying modules include a first end module mounted to an edge of one of the structural members, a second end module mounted to an edge of the other structural member and at least one intermediate module spaced between the first and second end modules.

Linkage control means operatively couple the load-carrying modules. The linkage control means include at least two spaced sets of linkages positioned between and interconnecting each adjacent pair of load-carrying modules for maintaining alignment and spacing of the modules in parallel relationship to each other in a direction generally transverse to the direction of the roadway and for proportionally maintaining generally equal spacing between the modules during expansion and contraction of the gap.

Aligned sleeve means are carried by and mounted generally below the upper surfaces of the load-carrying modules. At least two spaced elongated support beams are in fixed relationship with one of the end modules. The support beams are telescopically and slidably engageable with the aligned sleeve means generally in the direction of the roadway for supporting the load-carrying modules and for accommodating sliding movement of the load-carrying modules in response to expansion and contraction of the gap.

In one form the linkage control means include links pivotally connected to each of the load-carrying modules with some of the links having bifurcated forked ends and some of the links having tongue-shape blade-like ends. The links are constructed and arranged so that the bifurcated forked ends of the links on each module are pivotally connected to the tongue-shaped blade-like ends of the links on adjoining modules.

In one preferred form the aligned sleeve means are internally lined with bearing means for accommodating sliding movement of the support beams. The bearing means can include a pair of bearing shoes internally lined with a layer of material having a relatively low coefficient of friction for slidably contacting the support beam. The bearing shoes can include a first U-shaped shoe adapted to slidably receive the bottom of the support beam and an inverted U-shaped shoe positioned above the first U-shaped shoe for slidably receiving the top of the support beam. In some situations it is desirable to position an elastomeric pad between and against one of the U-shaped shoes and a load-carrying module.

In a preferred embodiment the support beams are fixed relative to the first end module and the aligned sleeve means include an elongated member secured to the second end module.

Resiliently yieldable sealing membranes can be provided to couple the load-carrying modules and protectively cover the linkage control means to substantially prevent water, dirt and other debris from clogging the linkages and from passing downwardly between the modules. Pads are preferably mounted upon the modules for providing a roadway over the gap.

A more detailed explanation of the invention is provided in the following description and appended claims taken in conjunction with the accompanying drawings.

BRIEF DESCRIPTION OF THE DRAWINGS

FIG. 1 is a fragmentary perspective view of a large motion expansion joint bridging an expansion gap between edges of adjacent structural members in accordance with the principles of the present invention and with parts broken away for ease of understanding and clarity;

FIG. 2 is a cross-sectional view of the large motion expansion joint taken along a line in the direction of the roadway;

FIG. 6 is an enlarged cross-sectional view taken substantially along line 6—6 of FIG. 3 and depicting the first end module with a support beam fixed thereto and carrying an aligned sleeve means circumscribing and supporting the support beam;

DETAILED DESCRIPTION OF THE ILLUSTRATIVE EMBODIMENT

Figure 3:
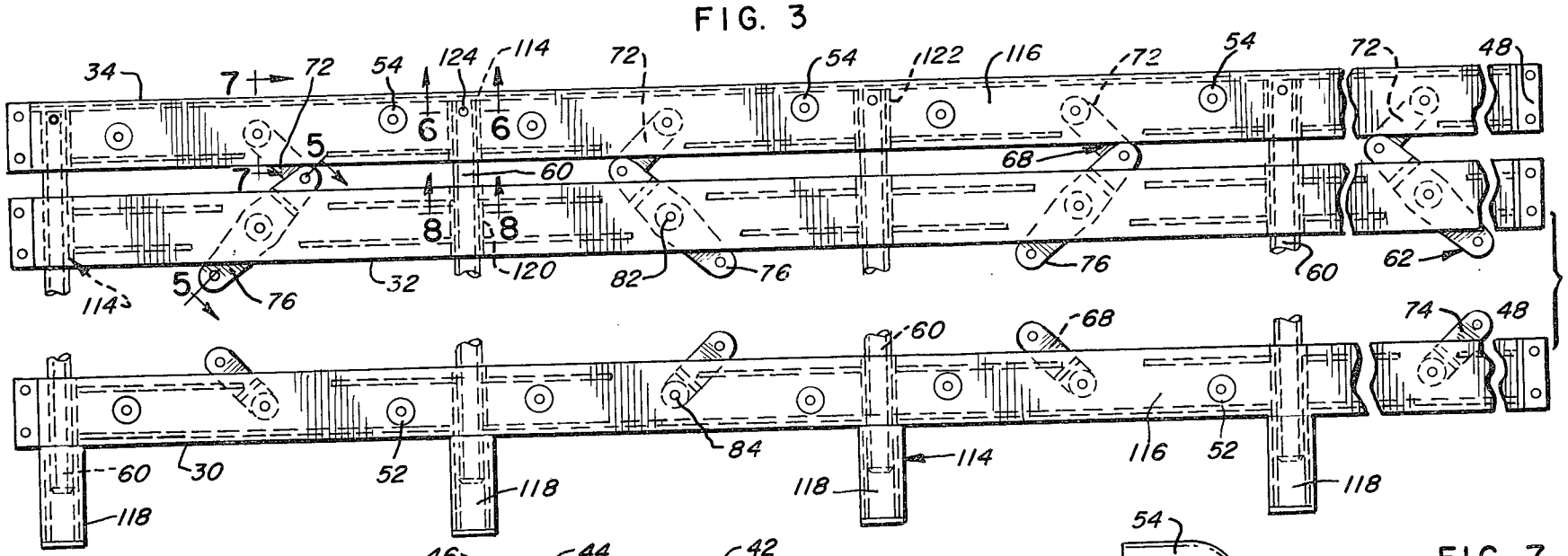
FIG. 3 is a fragmentary top plan view of the large motion expansion joint of FIG. 1.

Referring to FIGS. 1–8 of the drawings, a large motion expansion joint 10 is mounted upon and across and interconnects adjacent structural members, such as bridge deck slabs or sections 12 and 14, along a roadway 16 or the like, so as to bridge or span across an expansion gap or space between the adjacent deck slabs. Each of the deck slabs is formed of reinforced concrete or any other suitable material and is fabricated and shaped to have an upper stepped portion 18 and 20, respectively, and a lower stepped portion 22 and 24, respectively. The space between the lateral upright edges or faces 26 and 28 of the lower stepped portions generally defines the expansion gap 29. The width of the gap which is generally defined as the minimum distance between the upright lateral edges 26 and 28 of the deck sections 12 and 14, is dependent upon the expansion and contraction of the adjacent deck slabs.

Figure 4:
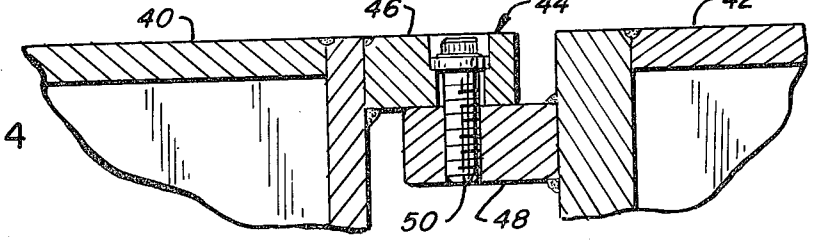
FIG. 4 is an enlarged cross-sectional view, partially fragmented, of one type of module connector for interconnecting adjacent module-segments of the load-carrying modules.

The large motion expansion joint 10 includes at least three load-carrying modules 30, 32 and 34 spaced in parallel relationship to each other and aligned generally transversely to the direction of the roadway 16. The space between each adjacent load-carrying module defines a subgap or increment 36 and 38. The maximum desirable spacing of the subgap, which is defined as the minimum distance between adjacent modules, will depend upon a variety of factors including the type of sealing system which is to be used with expansion joints. When seals of the membrane or convolution types are used, the maximum spacing between the modules should be four inches or less. Depending upon the width of the gap, the load-carrying modules may comprise a plurality of interconnected aligned module-segments such as 40 and 42, which are preferably supplied in lengths of about twelve feet and secured together to form the desired total length. FIG. 4 illustrates one type of construction for interconnecting adjacent module-segments. The construction of FIG. 4 depicts a module connector 44 having with one module-segment 40 providing an upper lateral extension or coupling segment 46 seated upon and interfacing a lower lateral extension or support segment 48 of an adjacent module-segment 42. The upper lateral extension 46 is somewhat supported by the lower lateral extension 48 and is counterbored in alignment with an aperture in the lower lateral extension 48 so as to receive a suitable fastener 50 such as a ferry cap counterbore screw, bolt or other fastener for fixedly securing the lateral extensions 46 and 48 to each other so as to interconnect the adjacent module-segments 40 and 42.

The load-carrying modules include a first end module 34 mounted to and upon the upper stepped portion 20 or edge of one of the structural members 14 and a second end module 30 mounted to and upon an upper stepped portion 18 or edge of the other structural member 12. At least one intermediate center module 32 is spaced between the first and second end modules. Each of the load-carrying modules is preferably constructed of a plurality of steel sections which are welded together to provide a steel weldment having a hollow interior cross-sectional area which is generally rectangular in shape.

Each of the end modules 30 and 34 are designed to be anchored or mounted to the adjacent deck slabs by first and second anchoring means, such as by anchor bolts 55 or by casting in situ in a secondary pouring operation. The cement overlays 57 and 59 are substantially flush with the top of the roadway 16 and deck slabs 12 and 14 and is held in place in part by anchors 52 and 54. The end modules provide support for the outer elastomeric side pads or dams 56 and 58, function as fixed and expansion bearings for the support beam 60, and locate the position of the control linkage 62. Desirably, both the end and intermediate modules 30, 32 and 34 as well as the support beam 60 are designed to AASHTO specification 1.3.6. (Distribution of Wheel Loads on Steel Grid Floors) using HS20 loading.

At least one intermediate module 32 is positioned and spaced between the first and second end modules 34 and 30. The number of intermediate modules is dependent upon the total motion of the large motion expansion joint. For example, if the maximum spacing is to be four inches between modules, then one intermediate module is necessary for a total joint motion of about eight inches; two intermediate modules are needed for a total joint motion of about 12 inches; etc. Of course, the number of modules may be varied according to needs and conditions.

Collectively, the intermediate modules 32 are designed to support the intermediate elastomeric side pads 64 and 66. The intermediate elastomeric side pads and the outer elastomeric side pads 56 and 58 each define a plurality of bolt holes or apertures 67 which are proportioned to accommodate and receive bolts 69 or other fasteners for securing the side pads 56, 58, 64 and 66 to the top of the load-carrying modules so as to provide a roadway surface over the module and across the gap. The bolt holes may later be filled with a suitable compound such as a flexible epoxy or a vulcanizable liquid rubber, which will fill the holes flush with the top surface of the side pads. Preferably, each side pad is provided with an embedded elongated reinforcing plate 71 and each has its respective top surface grooved with angular grooves or channels 73 to enhance traction of vehicle tires and to direct water away from the side pads into the area of the membranes.

Linkage control means such as control linkage system 62 operatively couple the load-carrying modules 30, 32 and 34 and includes at least two spaced sets of linkages 68 between and interconnecting each adjacent pair of load-carrying modules for maintaining alignment and spacing of the modules in a parallel relationship generally in a direction transverse to and preferably normal to the direction of the roadway 16 as well as for proportionally maintaining equal spacing between the modules 30, 32 and 34 during expansion and contraction of the gap 29. Preferably, adjacent sets of linkages are positioned in mirror image symmetry to each other to substantially cancel out operating forces. In the illustrative embodiment there are four such sets of linkages between and interconnecting each adjacent pair of load-carrying modules. Each of the sets of linkages 68 includes links or levers pivotally connected to each of the load-carrying modules 30, 32 and 34, including a first end link 72 pivotally connected to the first end module 34, a second end link 74 pivotally connected to the second end module 30 and an intermediate link 76 pivotally connected to the intermediate module 32. The end links 72 and 74 face the intermediate module 32 and need only be half the length of the intermediate link 76. The positions of the intermediate modules are determined by the link of the linkage control means 62. Some of the links have bifurcated forked ends 78 and some of the links have tongue-shaped blade-like ends 80 with the bifurcated forked ends 78 of the links on each module pivotally connected to the tongue-shaped blade-like ends 80 of the links on adjoining modules.

Figure 7:
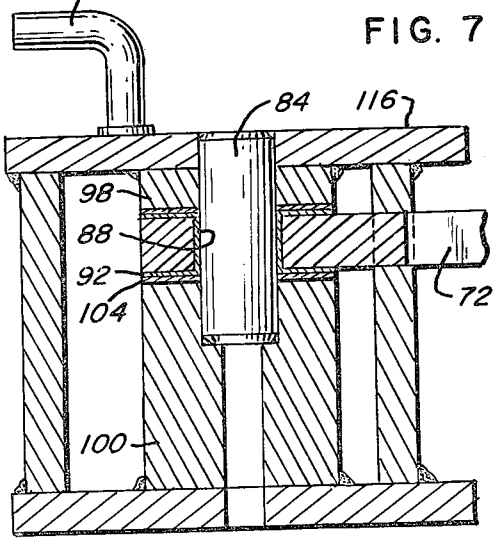
FIG. 7 is an enlarged cross-sectional view of the first end module taken substantially along line 7—7 of FIG. 3.
Figure 5:
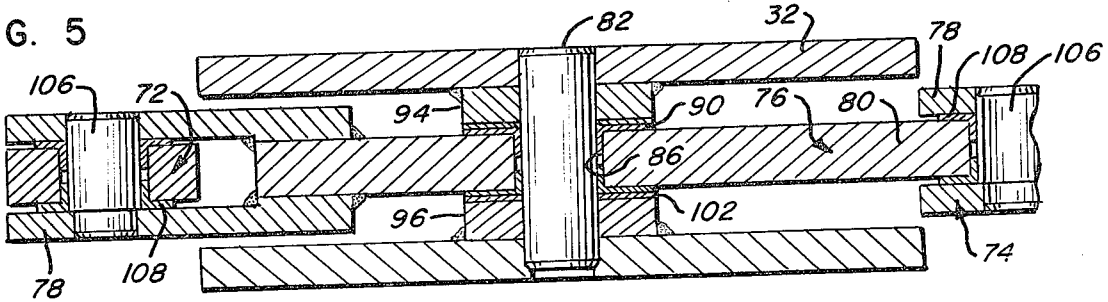
FIG. 5 is an enlarged cross-sectional view taken substantially along line 5—5 of FIG. 3.

As best seen in FIGS. 5 and 7, the links are pivotally connected to the modules 30, 32 and 34 by means of dowels or pins 82 and 84 which are secured to the modules and which pass through bores 86 and 88 of the links. In order to minimize rubbing contact and wear between the pins 82 and 84 of the associated links, polytetrafluoroethylene shouldered bushings 90 and 92 are securely fitted to the links about the bores 86 and 88. Upper and lower guide and support members or shims 94–100 are welded to the modules on the interior side of the upper and lower walls of the modules, respectively, and serve to elevate its associated links along a generally horizontal plane and into alignment with adjacent links so that the links can freely pivot without jamming and ramming into the top and bottom walls of the modules.

As best shown in FIG. 5, the upper and lower support and guide members 94 and 96 welded to the intermediate module 32 are of approximately the same size and depth. The lower support and guide members 100 illustrated in FIG. 7 and welded to each of the end modules 30 and 34 are substantially larger and deeper than the upper support and guide members 98 which are secured to the upper wall of the end modules. The larger size and depth of the lower end guide and support member 100 compensates for a larger depth of vertical height of the end modules 30 and 34 in comparison to the intermediate modules 32 so that the linkages of the linkage control system 62 all are positioned to generally lie in a common horizontal plane. In order to minimize wear, stainless steel washers 102 and 104 are positioned intermediate the polytetrafluoroethylene shouldered bushings 90 and 92 and the support and guide members 94–100.

The control linkage 62 is preferably of the Watts or single scissors design and spaced at three foot intervals. While other linkage designs and spacings can be used when desired, the preferred design allows for low operating force through the use of stainless steel and polytetrafluoroethylene pivots. Desirably the links are pivotally connected to each other by intermediate dowels 106 and polytetrafluoroethylene bushings 108. The preferred design of the control linkage 62 can easily follow the relative movement of adjacent bridge decks 12 and 14 and is extremely resistant to displacement from its prescribed path. Each control linkage 62 is preferably constructed and arranged to support the equivalent of the horizontal inertia force of HS20 axle load decelerated at 32 feet/second$^2$. The design of the lower arms of the linkages 62 further insures against the possibility of the linkages being positioned or locked at dead center. Furthermore, the linkage control means 62 positively assures that each module move only its proportional distance throughout the motion range under all conditions of operation, thereby to prevent straining the sealing members beyond their design range.

Figure 8:
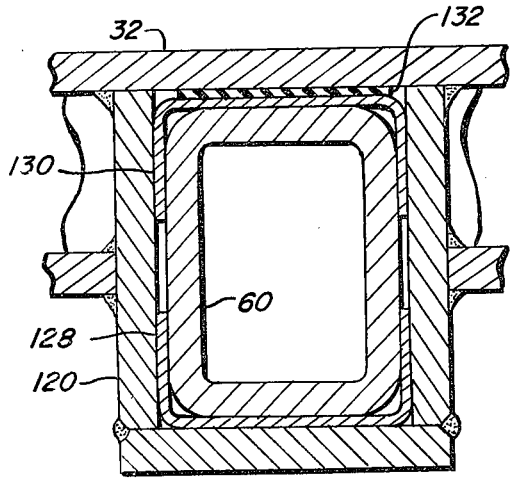
FIG. 8 is an enlarged cross-sectional view taken substantially along line 8—8 of FIG. 3 and illustrating an intermediate module carrying an aligned sleeve means with a bearing assembly slidably supporting the support beam.

A set of at least two generally parallel aligned sleeve means 114 are carried by and mounted generally below the upper surfaces or top walls 116 of each of the load-carrying modules 30, 32 and 34 generally in the direction of the roadway 16, there being one set of aligned sleeve means for each support beam 60. For each set of aligned sleeve means 114 associated with a support beam 60 there is an elongated member or support beam housing 118 carried by the second end module 30, an intermediate beam guide 120 having a hollow rectangular interior and carried by each of the intermediate modules 32 and an end beam retainer 122 carried by the first end module 34, each preferably defining a hollow rectangular interior. The elongated members or support beam housings 118 rest upon and are secured to the upper stepped portion 18 of the adjacent bridge deck 12 via the end module 30 to which they are fixed as by welding. The first end module 34 and beam retainers 122 carried by the first end module 34 are fixedly attached to the support beams 60 by socket head cap screws 124 or other fastening means as best shown in FIG. 6. Such aligned sleeve means telescopically receive the support beams 60 and can take the form of tubular beam guides 120 or beam retainers 122 having a rectangular hollow interior as best shown in FIGS. 8 and 6, respectively. Although the fastener 124 is used to fix the beams 60 to the first end module as is shown in FIG. 6, it will be apparent that such fasteners are absent from the beam and associated sleeve means at the other modules to permit sliding of the beams relative to the other modules.

In one preferred embodiment, the aligned sleeve means are internally lined with resilient bearing means such as bearing assembly 126 for each module 30, 32 and 34 to accommodate the sliding movement of the support beams 60. In the embodiment illustrated in FIGS. 1–8, the bearing assembly 126 includes a pair of bearing shoes 128 and 130 internally coated with a layer of material having a relatively low coefficient of friction, such as polytetrafluoroethylene, for slidably contacting the support beam. The bearing shoes for each module 30, 32 and 34 include a first U-shaped shoe 128 adapted to slidably receive the underside of the support beam 60 and an inverted U-shaped shoe 130 positioned above the first U-shaped shoe 128 for slidably receiving the top of the support beam 60. The shoes are fixed to the sleeve means to prevent movement of them longitudinally of the beams.

An elastomeric pad 132 such as a neoprene pad (see FIGS. 1 and 8), are preferably positioned between the inverted U-shaped shoe 130 and the top wall 116 of the intermediate module 32 to urge the inverted U-shaped shoe 130 against the top of the support beam 60 for sliding contact therewith and for minimizing noise when the roadway is in use. An outer elastomeric pad 134 can be positioned between the first U-shaped shoe 128 and the bottom wall 136 of the end modules as shown in FIG. 6 in order to cushion the sliding load of the support beams 60 and dampen vibrations and reduce noise. The elastomeric pads 132 and 134 adjacent the support beams 60 and U-shaped bearing shoes 128 and 130 serve as an anti-rattling device with the rubber being compressed and functioning somewhat like a bearing or spring to keep the support beams 60 and bearing shoes 128 and 130 in firm contact with each other.

The large motion expansion joint 10 includes at least two and preferably four spaced elongated support beams 60 lying generally in the direction of the roadway for supporting the load-carrying modules 30, 32 and 34. In the illustrative embodiment all of the support beams 60 are fixed relative to the sleeve means 114 associated with one of the end modules, such as the first end module 34, as with socket head cap screws 124. The support beams 60 are slidably engageable within the aligned sleeve means 114 associated with the other end and intermediate modules 30 and 32, respectively, for accommodating relative sliding movement of the other end and intermediate modules 30 and 32 in response to contraction and expansion of the gap 29.

In one form of construction, the support beams are spaced at three foot intervals along the expansion joint so as to provide ample support for the load-carrying modules 30, 32 and 34 and the vehicle load. The support beams 60 can be fabricated from structural tubing having a substantially uniform depth with a generally rectangular hollow interior. The beam depth is a function of its unsupported joint span length which is dependent upon the total motion of the expansion joint.

The fixed ends of the beams 60 utilize the continuous web of the first end module 34 to prevent entry of foreign material and debris into the interior of the support beam. The ends of the support beams 60 adjacent the second end module 30 is provided with a sheet metal cover 138 which covers that end of the support beam. Housing 138 is preferably fixed to the second end module 30 to substantially prevent slide mechanism contamination.

The support beams 60 as well as the linkages 62 are plated such as with chrome plating to provide a corrosion free slip surface for the system.

Sealing means such as resiliently yieldable and flexible sealing convolutions or membranes 112 such as the type described in U.S. Pat. No. 3,713,368 couple the load-carrying modules 30, 32 and 34 and protectively overlie the linkage control means 62 for substantially preventing water, dirt and other debris from clogging the linkages. The sealing membranes 112 may have an upstanding arched configuration and are mounted upon the top surface 116 of the load-carrying modules 30, 32 and 34 adjacent and against the underside of the side pads or threads 56, 58, 66 and 64. The sealing membranes generally cover the entire subgap 36 and 38 between adjacent load-carrying modules 30, 32 and 34 and expand and contract in response to expansion and contraction of the expansion gap 29. In the illustrative embodiment the flexible sealing membranes 112 each have side-flap portions 140 and 142 mounted between the elastomeric side pads 56, 58, 66 and 64 and the tops 116 of the load-carrying modules 30, 32 and 34.

In one form of construction the load-carrying modules 30, 32 and 34 and linkage control means 62 can be fabricated from ASTM 588 steel and the support beams or girders 60 can be fabricated from A500 (B) steel. Additionally, in the preferred embodiment the depth of the lower stepped portions 22 and 24 of the bridge decks 12 and 14 are sufficiently deep to accommodate deflection of the large motion expansion joint 10 under vehicle load and to prevent rubbing contact and interference of the bridge decks 12 and 14 with sliding intermediate modules 32.

Desirably, the intermediate modules 32 which are constructed and arranged to support traffic loads and braking forces, are capable of moving easily in parallel relationship to each other in substantially equal increments in response to motion of the deck support members 12 and 14 because of the combination of the linkage control means 62, aligned sleeve means 114 and support beams 60. Sufficient surface to support beam rotation is accommodated by the fixed end of the support beam 60 along with the neoprene backed polytetrafluoroethylene bearing shoes 128 and 130.

Figure 9:
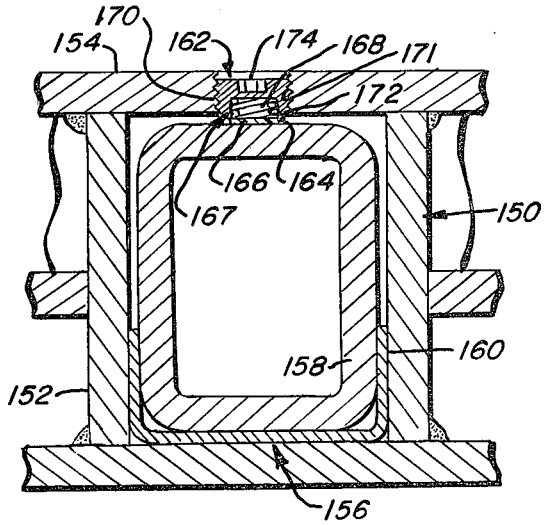
FIG. 9 is an enlarged cross-sectional view similar to FIG. 8 but illustrating a modified bearing assembly slidably supporting the support beam in accordance with principles of the present invention.

In the embodiment shown in FIG. 9, the aligned sleeve means 150 and particularly the tubular beam guide 152 carried by the intermediate module 154 is internally lined with another form of bearing means such as bearing assembly 156 to accommodate sliding movement of the support beam 158. The components of the bearing assembly 156 include a U-shaped shoe 160, similar to the first U-shaped shoe 128 of the embodiment illustrated in FIG. 8, and adjustable means, such as adjustable assemblage 162, for selectively controlling the amount of compression force exerted on the support beam 158 by the bearing means so as to control the extent of engagement between the support beam 158 and the bearing means. Desirably, the adjustable means include a contacting member, such as a planar or generally flat button-like member 164, having an exterior or facing surface 166 for engaging and accommodating any sliding movement of the support beam. The exterior surface 166 of the button 164 is preferably of a material having a relatively low coefficient of friction, such as polytetrafluoroethylene.

The adjustable assemblage 162 of bearing assembly 156 also includes biasing means 167, such as compression spring 168, for urging the button-like member 164 against the support beam 158, and further includes control means, such as an externally threaded sleeve 170 operatively associated with the biasing means 167 for selectively controlling the compression force exerted on the support beam 158 by the member 164. In order to accommodate and snugly seat the adjustable means, the intermediate module 154 is drilled and tapped to form an internally threaded opening 171 for receiving the threaded sleeve 170. In the illustrative embodiment of FIG. 9 the sleeve 170 is undercut so as to form a pocket 172 for snugly receiving the biasing means 167. When properly installed, sleeve 170 urges the biasing means 167 against the button-like member 164 so that the bearing assembly 156, via member 164, exerts a controlled compressive force on the support beams. The upward portion of sleeve 170 has an internal slot or opening 174, which in the illustrative embodiment takes the form of an internal hexagonal-shaped socket for snugly receiving the head 176 of a wrench or tool 178, of the type illustrated in FIG. 10. When the tool is inserted in the opening 174 of the sleeve and rotated either clockwise or counterclockwise, the sleeve 170 will rotate and move toward or away from the support beam 158 so as to selectively adjust the amount of biasing force exerted by the biasing means 167 on the button-like member 164 and concomitantly selectively adjust the amount of compression force exerted on the support beam 158 by the member 164. The adjustable assemblage 162 of the bearing assembly 156 is particularly useful to increase the compression force exerted on the support beam 158 by the bearing assembly 156 so as to substantially maintain the support beam 158 and bearing assembly 156 in engagement and reduce clearance between the bearing assembly 156 and the support beam 158 so that live loads do not cause substantial impact noise.

Figure 10:
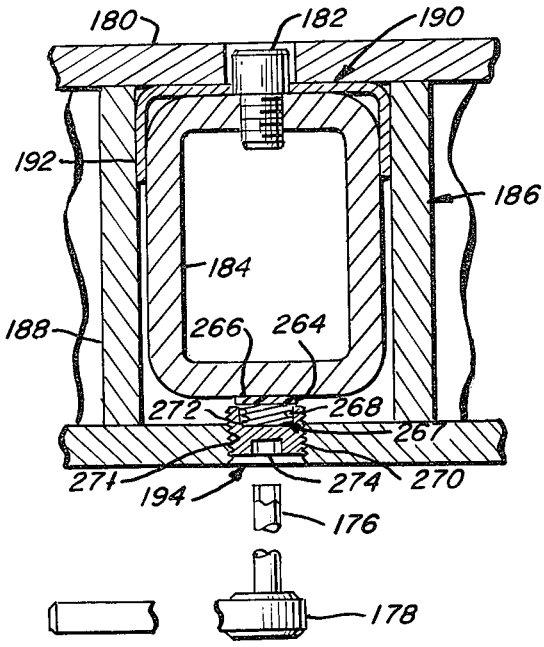
FIG. 10 is an enlarged cross-sectional view similar to FIG. 4 but illustrating a modified type of bearing assembly which can be employed in accordance with principles of the present invention and illustrating a fragmentary portion of a tool which can be used for increasing the compressive force exerted on the support beam by the bearing assembly.

In the embodiment shown in FIG. 10, the first end module 180 has a socket head cap screw 182 or other fastening means fixedly securing the support beam 184 similar to the embodiment shown in FIG. 6. As previously discussed, the second end module does not include such fastening means in order to permit sliding movement of the support beam relative to the second end module. In FIG. 10 the aligned sleeve means 186 and particularly the beam retainer 188 carried by the first end module 80 is internally lined with another type of bearing means such as bearing assembly 190. The bearing assembly 190 includes an inverted U-shaped shoe 192 similar to the inverted U-shaped shoe 130 shown in the embodiment of FIG. 6 and includes adjustable means such as adjustable assemblage 194 disposed on the underside of the support beam 184 for selectively controlling the amount of compression force exerted on the support beam by the bearing means so as to control the extent of engagement between the support beam 184 and the bearing means. The adjustable assemblage 194 of bearing assembly 190 in FIG. 10 is substantially identical to the adjustable assemblage 162 of the bearing assembly 156 illustrated in FIG. 9 except that the adjustable assemblage 194 of FIG. 10 is positioned to engage the underside of the support beam 184 rather than on the top of the support beam 158 as is done by adjustable means 162 in FIG. 9. For purposes of clarity and ease of understanding, similar parts of adjustable means 190 in FIG. 10 have been numbered similarly to the parts of adjustable means 167 of FIG. 9, but with numbers in the 200 series. For example, member 264, biasing means 267, etc.

Figure 11:
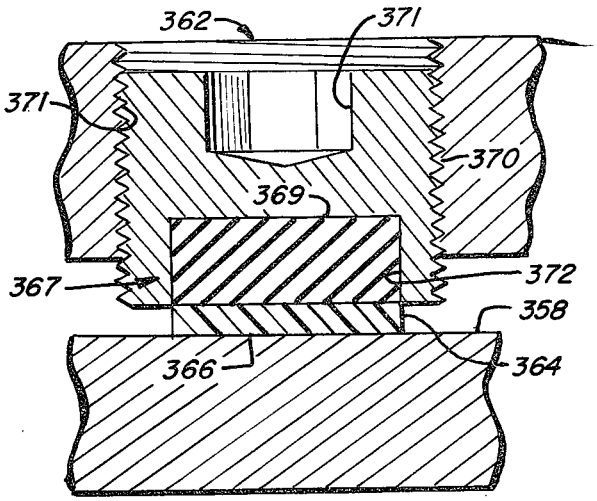
FIG. 11 is an enlarged fragmentary cross-sectional view of another embodiment of a bearing assembly which may be used in lieu of the embodiments of FIGS. 9 and 10.

The adjustable assemblage 362 of the embodiment shown in FIG. 11 is substantially the same as the adjustable assemblage 162 of the embodiment illustrated in FIG. 8, except that the biasing means 367 takes the form of a resilient elastomeric pad 369 rather than a compression spring 168. The elastomeric pad 369 snugly fits into the pocket 372 of the sleeve 370 and is positioned to urge the member 364 against the support beam 358. The adjustment features, function and characteristics of the adjustable assemblage 362 of FIG. 11 is substantially the same as the adjustable assemblage 162 of FIG. 9, and for ease of understanding similar parts of adjustable assemblage 362 have been given numbers similar to the parts of adjustable assemblage 162, but in the 300 series, such as sleeve 370, member 364, etc.

In some circumstances it may also be desirable that the biasing means 267 of the adjustable assemblage 190 in FIG. 10 takes the form of a highly resilient elastomeric pad. Such an adjustable assemblage would be substantially similar to the adjustable assemblage 362 of FIG. 11 but rotated 180° so as to engage the underside of the support beam.

Although specific embodiments have been shown and described, it should be understood by those skilled in the art that various modifications and substitutions can be made without departing from the novel spirit and scope of this invention.

What is claimed and desired to be secured by Letters Patent of the United States is:

1. A large motion expansion joint for bridging a gap between edges of structural members forming a roadway comprising, in combination:

at least three elongate load-carrying modules spaced in parallel relationship to each other and aligned generally transversely to the direction of the roadway, each of said load-carrying modules having an upper surface, said load-carrying modules including a first end module mounted to an edge of one of the structural members, a second end module mounted to an edge of the other structural member, and at least one intermediate module spaced between said first and second end modules;

linkage control means operatively coupling the load-carrying modules, including at least two spaced sets of linkages between and interconnecting each adjacent pair of load-carrying modules for maintaining alignment and spacing of said modules in their parallel relationship in a direction generally transverse to the direction of the roadway, said linkages including links pivotally connected to the modules for positively proportionally maintaining generally equal spacing between said modules during expansion and contraction of the gap;

aligned sleeve means carried by, and mounted generally below the upper surfaces of, said intermediate module and at least one of said end modules; and at least two spaced elongated support beams lying generally in the direction of the roadway for supporting the load-carrying modules; each said support beam being in fixed relationship within the said sleeve means associated with one of said end modules and being movable relative to said intermediate module and in slidable engagement within the said sleeve means associated with the other of said end and intermediate modules for accommodating sliding movement of said other end and said intermediate load-carrying modules in response to expansion and contraction of the gap.

2. A large motion expansion joint in accordance with claim 1 wherein each of said elongate load-carrying modules comprises a plurality of aligned module-segments interconnected in the direction of their lengths.

3. A large motion expansion joint in accordance with claim 1 wherein at least some of the aligned sleeve means are internally lined with resilient bearing means.

4. A large motion expansion joint in accordance with claim 3 wherein each resilient bearing means includes a pair of bearing shoes having linings of material having a relatively low coefficient of friction for slidably contacting said support beams, said bearing shoes including a first U-shaped shoe adapted to slidably receive the bottom of a support beam and an inverted U-shaped shoe positioned above the first U-shaped shoe for slidably receiving the top of a support beam.

5. A large motion expansion joint in accordance with claim 4 further including an elastomeric pad positioned between a U-shaped shoe and a load-carrying module.

6. A large motion expansion joint in accordance with claim 3 wherein the support beam is fixed relative to the first end module and the aligned sleeve means include an elongated sleeve member secured to the second end module.

7. A large motion expansion joint in accordance with claim 1 further including resiliently yieldable sealing membranes extending along the gaps between the load-carrying modules and protectively covering the linkage control means for substantially preventing water, dirt and other debris from passing between the modules and from clogging the linkages.

8. A large motion expansion joint in accordance with claim 7 including side pads mounted upon the upper surfaces of the modules for providing a roadway surface across the gap.

9. A large motion expansion joint in accordance with claim 3 wherein said resilient bearing means include adjustable means for selectively adjusting the amount of compression force exerted on said support beams by said bearing means.

10. A large motion expansion joint in accordance with claim 9 wherein said adjustable means comprise:

a contacting member having a facing surface for engaging a said support beam, said facing surface being of a material having a low coefficient of friction, biasing means for urging said contacting member against said support beam, and control means operatively associated with said biasing means for selectively controlling the amount of compression force exerted on said beam by said contacting member.

11. A large motion expansion joint for bridging a gap between edges of structural members forming a roadway comprising, in combination:

at least three elongate load-carrying modules spaced in parallel relationship to each other and aligned generally transversely to the direction of the roadway, each of said load-carrying modules having an upper surface, said load-carrying modules including a first end module mounted to an edge of one of the structural members, a second end module mounted to an edge of the other structural member, and at least one intermediate module spaced between said first and second end modules;

linkage control means operatively coupling the load-carrying modules, including at least two spaced sets of linkages between and interconnecting each adjacent pair of load-carrying modules for maintaining alignment and spacing of said modules in their parallel relationship in a direction generally transverse to the direction of the roadway and for proportionally maintaining generally equal spacing between said modules during expansion and contraction of the gap, wherein each set of linkages includes links pivotally connected to each of the load-carrying modules, some of the links having bifurcated forked ends and some of the links having tongue-shaped blade-like ends with the bifurcated forked ends of the links on each module pivotally connected to the tongue-shaped blade-like ends of the links on adjoining modules;

aligned sleeve means carried by, and mounted generally below the upper surfaces of, said load-carrying modules; and at least two spaced elongated support beams lying generally in the direction of the roadway for supporting the load-carrying modules; each said support beam being in fixed relationship within the said sleeve means associated with one of said end modules and being in slidable engagement within the said sleeve means associated with the other of said end and intermediate modules for accommodating sliding movement of said other end and said intermediate load-carrying modules in response to expansion and contraction of the gap.

12. A large motion expansion joint for bridging a gap between stepped edges of structural members forming a roadway or the like, comprising, in combination:

at least three elongated load-carrying modules spaced in parallel relationship to each other and aligned generally transversely to the direction of the roadway and including a first end module, first anchoring means for mounting of said first end module to one of said structural members, a second end module, second anchoring means for mounting of said second end module to the other structural member, and at least one intermediate module spaced between said first and second end modules;

linkage control means operatively coupling the load-carrying modules, including at least two horizontally oriented spaced sets of linkages between and interconnecting each adjacent pair of load-carrying modules for substantially maintaining alignment and spacing of said modules in their parallel relationship in a direction generally transverse to the direction of the roadway, said linkages comprising links pivotally connected to the modules, for positively proportionally maintaining substantially equal spacing between said modules during expansion and contraction of the gap;

elastomeric sealing means coupling the modules and protectively covering the linkage control means for substantially preventing water, dirt and other debris from passing downwardly through the gap;

a set of at least two generally parallel aligned sleeve means carried by and mounted to the intermediate module and at least one of said end modules below the elastomeric sealing means substantially in the direction of the roadway, each of said aligned sleeve means including an elongated member seated upon and mounted to the stepped edge of one of the structural members adjacent said second end module;

bearing means lining the interior of the sleeve means; and at least two spaced elongated support beams lying generally in the direction of the roadway for supporting the load-carrying modules; each said support means being in fixed relationship within the said sleeve means associated with one of said end modules and being movable relative to said intermediate module and in slidable engagement within the said sleeve means associated with the other of said end and intermediate modules for accommodating sliding movement of said other end and said intermediate load-carrying modules in response to expansion and contraction of the gap.

* * * * *